US011945565B1

(12) United States Patent
Deole et al.

(10) Patent No.: US 11,945,565 B1
(45) Date of Patent: Apr. 2, 2024

(54) MARINE VESSELS AND METHODS OF MAKING MARINE VESSELS PROVIDING AIR FLOW FOR AN ENGINE COMPARTMENT

(71) Applicant: Brunswick Corporation, Mettawa, IL (US)

(72) Inventors: Prasad Dhananjay Deole, Winter Springs, FL (US); Matthew P. Klausky, Port Orange, FL (US); Paul E. Olvera, Edgewater, FL (US); Zachary M. Handziak, Columbia, TN (US)

(73) Assignee: Brunswick Corporation, Mettawa, IL (US)

( * ) Notice: Subject to any disclaimer, the term of this patent is extended or adjusted under 35 U.S.C. 154(b) by 383 days.

(21) Appl. No.: 17/369,379

(22) Filed: Jul. 7, 2021

(51) Int. Cl.
*B63J 2/06* (2006.01)
*F24F 7/06* (2006.01)

(52) U.S. Cl.
CPC .. *B63J 2/06* (2013.01); *F24F 7/06* (2013.01)

(58) Field of Classification Search
CPC ..... B63J 2/06; F24F 7/06
See application file for complete search history.

(56) References Cited

U.S. PATENT DOCUMENTS 3,465,665 A * 9/1969 O'Day ..... F02P 11/06 454/78
4,250,829 A 2/1981 Stephens
D281,595 S 12/1985 Fulster
D291,592 S 8/1987 Flowers
D308,850 S 6/1990 McGuire
6,799,546 B1 10/2004 Gonring et al.
(Continued)

FOREIGN PATENT DOCUMENTS

CN 305594449 2/2020
GB 6175047 11/2021
(Continued)

OTHER PUBLICATIONS

Marine City 304 Grade Stainless-Steel Rectangle Stamped Louvered Vent, available in Amazon.com, date first available Aug. 27, 2019 [online], [site visited May 18, 2023], Available from the internet URL:https://www.amazon.com/marine-city-stainless-steel-rectangle-louvered/dp/B07GVX1KL1/ref=sr_1_1_sspa?keywords=bilge%2Bve.

(Continued)

*Primary Examiner* — Stephen P Avila
(74) *Attorney, Agent, or Firm* — Andrus Intellectual Property Law. LLP

(57) ABSTRACT

A marine vessel including a hull extending horizontally from a bow to a stern with a midpoint therebetween. The hull has opposing walls that extend upwardly, where the opposing walls have inner sides that face inwardly toward each other and outer sides that face outwardly. A first of the outer sides defines a first opening therein that is horizontally closer to the midpoint than to the stern and horizontally closer to the midpoint than to the bow. An engine compartment is configured for positioning an engine therein. A first conduit fluidly couples the first opening and the engine compartment for at least one of ventilating and exhausting the engine compartment. The first opening is positioned to prevent water from entering the first conduit.

20 Claims, 6 Drawing Sheets

(56) References Cited

U.S. PATENT DOCUMENTS

| | | | | |
|---|---|---|---|---|
| 6,863,582 | B1 * | 3/2005 | Wynne | B63B 34/10 114/211 |
| D526,942 | S | 8/2006 | Delashaw et al. | |
| 7,597,760 | B2 | 10/2009 | Lammers et al. | |
| 7,806,741 | B1 | 10/2010 | Baier et al. | |
| 7,954,443 | B2 | 6/2011 | Mason | |
| D685,314 | S | 7/2013 | Gros | |
| 8,535,104 | B1 | 9/2013 | Nida | |
| D730,801 | S | 6/2015 | Herzberger | |
| 9,126,664 | B1 | 9/2015 | Denson et al. | |
| D787,384 | S | 5/2017 | Ito et al. | |
| D795,783 | S | 8/2017 | Johannesson et al. | |
| D812,544 | S | 3/2018 | Potts et al. | |
| 9,937,984 | B2 | 4/2018 | Herrington et al. | |
| D845,210 | S | 4/2019 | Wilkes | |
| D870,636 | S | 12/2019 | Boykin | |
| D877,667 | S | 3/2020 | Doveri | |
| 10,975,762 | B1 | 4/2021 | Langenfeld et al. | |

FOREIGN PATENT DOCUMENTS

| | | | |
|---|---|---|---|
| IN | 270034-00001 | | 11/2015 |
| KR | 20160050213 | A * | 5/2016 |

OTHER PUBLICATIONS

New Boat Bilge Vent Louver Sea Ray Mariner Bayliner SeaRay Off White 4 Pack, available in Amazon.com, dare first available Apr. 20, 2015 [online], [site visited May 18, 2023], Available from the internet URL:https://www.amaon.com/Bilge-Louver-Marine-Bayliner=Searay/dp/B00WF9NQAU/ref=sr_1_5?keywords=bilge+vent&qid=168441.

Five Oceans FO1675 Louvered Flush Hose Ventilators, available in Amazon.com. Date first available Nov. 1, 2013 [online], [site visited May 18, 2023], Available from the internet URL:https://www.amazon.com/five-oceans-louvered-flush-FO-1675/dp/B00GDLRABM/ref=sr_1_120_sspa?keywords=bilge%2Bvent&qid=1684415875& . . . .

* cited by examiner

MARINE VESSELS AND METHODS OF MAKING MARINE VESSELS PROVIDING AIR FLOW FOR AN ENGINE COMPARTMENT

FIELD

The present disclosure generally relates to marine vessels and methods of making marine vessels providing air flow for an engine compartment.

BACKGROUND

The following U.S. Patents provide background information and are incorporated by reference in entirety.

U.S. Pat. No. 9,937,984 discloses a wake control system aft of the driveshaft, propeller, and rudder of a vessel that includes a fin base and at least one fin slidingly engaged with the fin base. The fin(s) are vertically oriented and extend down into the water surface. The fins are transversely adjustable along the fin base to redirect a wake generated by the boat. In other embodiments, fin tabs are selectively deployable and retractable into and out of the water surface to redirect a wake generated by the vessel from one side to the other. A novel underwater exhaust system redirects exhaust depending on speed of the vessel and complements the wake control system.

U.S. Pat. No. 6,799,546 discloses a method for starting a marine internal combustion engine independent of a continued signal received from a starting switch. If the operator of the marine vessel momentarily depresses a starting switch, a predetermined procedure is followed by a microprocessor that does not require continued involvement of the marine vessel operator. Various parameters are checked during the starting sequence and various actuators are activated to assure a safe and reliable starting procedure.

U.S. Pat. No. 4,250,829 discloses a vapor sensitive switch for a marine engine. An alarm device is connected to the battery. A test switch varies the circuit connection of the vapor sensitive switch to simulate a high or low limit condition and thereby test circuit operation.

U.S. Pat. No. 8,535,104 discloses a marine battery provides power to a marine vessel. A cooling system comprises a substantially air-tight housing, at least one battery disposed in the housing, a heat exchanger circulating cooling fluid through the housing, and a fan circulating cooling air along a series of flow paths comprising a first flow path across the heat exchanger and the at least one battery and a second flow path returning to the fan.

U.S. Pat. No. 9,126,664 discloses a watercraft comprising a bow, a stern, a hull, a transform, and a deck. The transom is located at the stern of the watercraft and the deck extends forward from the transom. One or more cavities are disposed through the deck adjacent to the transom wherein the cavities are each configured to receive an outboard motor. An enclosure is disposed over each of the cavities, providing a means to hide and enclose the outdoor motor. The top of the enclosure includes a seating surface, providing a sun deck for boaters. The enclosures are hingeably mounted to the deck to provide selective access to the enclosures respective cavity and motor therein. The interior of the enclosures defines a curved surface to promote air turnover inside the enclosures, optimizing engine performance.

U.S. Pat. Nos. 10,975,762; 7,597,760; and 7,806,741 also generally relate to the present disclosure and are incorporated by reference herein in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a marine vessel including a hull extending horizontally from a bow to a stern with a midpoint therebetween. The hull has opposing walls that extend upwardly, where the opposing walls have inner sides that face inwardly toward each other and outer sides that face outwardly. A first of the outer sides defines a first opening therein that is horizontally closer to the midpoint than to the stern and horizontally closer to the midpoint than to the bow. An engine compartment is configured for positioning an engine therein. A first conduit fluidly couples the first opening and the engine compartment for at least one of ventilating and exhausting the engine compartment. The first opening is positioned to prevent water from entering the first conduit.

In another embodiment, the outer sides define a first opening and a second opening therein, respectively, which are each horizontally closer to the midpoint than to the stern and horizontally closer to the midpoint than to the bow. A first conduit fluidly couples the first opening and the engine compartment for ventilating the engine compartment, and a second conduit fluidly couples the second opening and the engine compartment for exhausting the engine compartment. The first opening and the second opening are positioned to prevent water from entering the first conduit and the second conduit. A fan is operatively coupled within the second conduit to force air from the engine compartment via the second conduit. A tower has opposing feet with a raised section therebetween, where the opposing feet are coupled to the tops of the opposing walls and horizontally aligned at least in part with the first opening and the second opening, respectively. The opposing feet are coupled to the opposing walls via fasteners accessible via the first opening and the second opening, respectively.

An exemplary method according to the present disclosure generally relates to assembling a marine vessel. The method includes providing a hull extending horizontally from a bow to a stern with a midpoint therebetween. The hull has opposing walls that extend upwardly, where the opposing walls have inner sides that face inwardly toward each other and outer sides that face outwardly. The method further includes configuring the outer sides to define a first opening and a second opening therein, respectively. The first opening and the second opening are each horizontally closer to the midpoint than to the stern and horizontally closer to the midpoint than to the bow. The method further includes providing an engine compartment configured for positioning an engine therein. The method further includes fluidly coupling the engine compartment to the first opening via a first conduit for ventilating the engine compartment, and fluidly coupling the engine compartment to the second opening via a second conduit for exhausting the engine compartment. The first opening and the second opening are each positioned to prevent water from entering the first conduit and the second conduit, respectively.

Various other features, objects and advantages of the disclosure will be made apparent from the following description taken together with the drawings.

BRIEF DESCRIPTION OF THE DRAWINGS

The present disclosure is described with reference to the following drawings.

DETAILED DISCLOSURE

Figure 1:
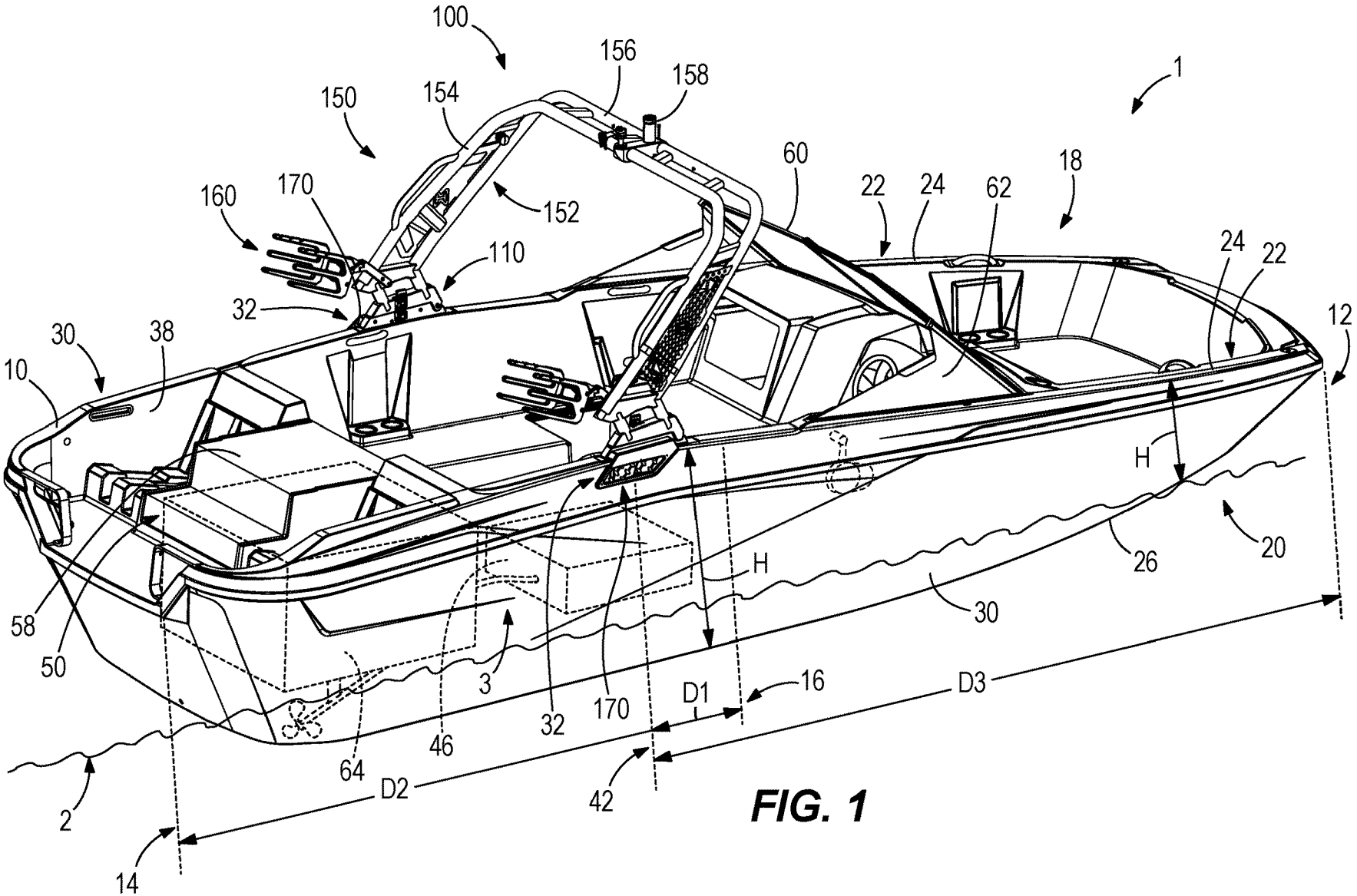
FIG. 1 is an isometric view of a starboard side of a marine vessel according to the present disclosure.

The present disclosure generally relates to marine vessels, and particularly those in which an engine is contained within an engine compartment of a hull. The engine compartment may be a portion of a bilge of the marine vessel, whereby the bilge may also contain a fuel tank for supplying the engine with fuel. Marine vessels known in the art commonly provide for ventilating and exhausting the engine compartment or bilge more generally. In certain examples, the operator is instructed to operate a fan for a predetermined time before starting the engine. This removes any explosive vapors within the engine compartment from the engine and/or fuel tank, preventing explosion upon starting the engine. These marine vessels may include openings for the intake of fresh air for ventilation, and for exhausting of the vapors, for the engine compartment or bilge in general.

Marine vessels presently known in the art often position these openings toward the stern of the marine vessel to avoid water from splashing and entering these openings when underway. The openings may face outwardly and/or upwardly from the walls of the hull, or in other locations of the marine vessel such as upwardly from the deck. When facing upwardly, the present inventors have recognized that these openings (and related grates or louvers) create a stumbling hazard for operators and passengers entering and exiting the marine vessel. The upward facing opening (and related grates or louvers) may also be damaged from being stepped on or otherwise contacted. Similarly, upward facing openings allow water to easily enter the bilge, for example from passing wet equipment over top, or stepping over the opening with a dripping wet bathing suit. These issues also exist for upward facing openings in other locations on the marine vessel, including those positioned in front of the windshield (another convenient location for passing equipment or boarding the marine vessel, whereby one can use the windshield for balance).

The present inventors have further recognized that the nature of certain types of marine vessels and water activities further exacerbate the problem of water entering the openings, including those located near the stern. For example, marine vessels used for wake sports such as wake surfing or wake boarding are designed to displace a lot of water near the stern. It is not uncommon for the water spray to cover the entire rear quarter of one or more sides of the marine vessel while wake surfing (including covering the entire height of the hull in this region). Moreover, this spray is likely to amplify as the marine vessel speed and ballast increases, which is a necessary condition for wake boarding since it is typically done at speeds twice as fast as the speeds necessary for wake surfing. Consequently, openings located near the stern tend to encounter a significant amount of wake spray, which leads to excessive water within the bilge and damage to the marine vessel.

In certain examples, marine vessels known in the art locate the openings in different positions for the intake side and exhaust side. For example, the opening for the intake side (i.e., for ventilating) may be positioned to face upwardly in front of the windshield, with the exhausting side facing outwardly aft of the marine vessel. However, due to the spraying discussed above, the present inventors have recognized that even the outward, aft facing configuration tends to be problematic.

It is known that openings should never be covered by towels, swim gear, or other items, which would reduce or prevent the air flow needed for ventilating and/or exhausting the engine compartment. In addition, the required size of the openings to provide sufficient air flow often dictates the location of these openings within the marine vessel, which the present inventors have recognized often interferes with the desired aesthetic of the marine vessel. For example, the openings may be interfere with features such as deck steps, cleats, lights, and/or other style features (e.g., locations, sizes, shapes, the visual appearance, or general configurations of these features). Likewise, when the openings are positioned too closely to another feature, there is a high likelihood of the operator at least partially blocking air flow when using the feature. For example, in the case of a cleat, air flow via the opening may be impacted by hanging items on the cleat (e.g., a life jacket or drying swimsuit), or by coiling a rope on the cleat in an otherwise intended manner.

In view of this, the present inventors have recognized that marine vessels presently known in the art do not adequately prevent water from entering the openings for the engine compartment while also providing the necessary airflow.

FIG. 1 shows a marine vessel 1 according to the present disclosure. As will be described in further detail, the marine vessel 1 has been developed to provide sufficient air flow for ventilating and exhausting the engine compartment, while nonetheless protecting against excessive water entering the bilge. The marine vessel 1 includes a hull 10 configured to float in water 2 in a customary manner. The hull 10 extends horizontally between the bow 12 and stern 14 within a midpoint 16 defined centrally therebetween. The hull 10 is further characterized as having a port side 18 and a starboard side 20 that each extend from the bow 12 to the stern 14. The hull 10 includes walls 22 that extend upwardly to tops 24. A height H is defined between the top 24 and a bottom 26 of the hull 10. The height H is measured normal to the water 2 and varies between the bow 12 and stern 14. The walls 22 have inner sides 28 facing inwardly towards each other, and outer sides 30 facing away from each other.

In certain embodiments, the walls 22 are formed in part or in whole by a deck mounted atop the hull 10 to extend upwardly therefrom in a manner known in the art. In this case, the openings 32 described herein below may be defined within the hull 10, within the deck atop the hull 10, or both. Likewise, the tower 100 described herein below may be coupled to the hull 10, and/or the deck atop the hull 10. For simplicity, the walls 22 will be described herein as being part of the hull 10 extending from the bottom 26 to the top 24 as shown in FIG. 1. However, it should be recognized that the walls 22 as contemplated by the present disclosure include any combination of hull and/or deck between the bottom 26 and top 24.

Openings 32 are defined within the outer sides 30 of the walls 22 that open to an interior of the walls 22 between the outer sides 30 and inner sides 28. In this manner, the openings 32 face outwardly from the walls 22. Through experimentation and development, the present inventors have identified improved locations for positioning the openings 32 within the marine vessel 1. In the example shown, the openings 32 are positioned at or near the tops 24 of the walls 22, maximizing the distance over the water 2. Moreover, the openings 32 are positioned to be horizontally closer to the midpoint 16 than to either the bow 12 or stern 14. Specifically, the opening 32 has a center 42 horizontally positioned a first distance D1 from the midpoint 16, a second distance D2 from the stern 14, and a third distance D3 from the bow 12. The hull 10 is configured such that the maximum height H occurs at or near the midpoint 16 (such as being between 2' and 3'6", for example 2'9"), once again maximizing the distance between the opening 32 and the water 2. The height H may remain at or near its maximum height at the center of the opening 32 (e.g., within 1-2" thereof). In certain examples, the first distance D1 is between 0" and 6' (e.g., approximately 3' 3"), the second distance D2 is between 6' and 9" (e.g., approximately 7'9"), the third distance D3 is between 12' and 16' (e.g., approximately 14'6"), and the length from the bow 12 to the stern 14 is between 18' and 25' (e.g., approximately 22'6").

The openings 32 are at least partially covered or hidden by covers 170. In the example shown, the covers 170 are horizontally aligned with the openings 32. Additional information regarding the covers 170 is provided below.

With continued reference to FIG. 1, within the hull 10 is an engine compartment 50 (positioned within a bilge 3) that is configured to contain an engine 64 therein. The engine 64 may be an internal combustion engine configured to run on gasoline or diesel, for example. The engine 64 of FIG. 1 is concealed by a cover 58 in a manner presently known in the art. A fuel tank 46 is also provided within the bilge 3. As will be discussed further below, the openings 32 in the walls 22 of the hull 10 provide air flow for the bilge 3 (also referred to herein as providing air flow, including ventilating and exhausting, for the engine compartment 50).

The marine vessel 1 of FIG. 1 further includes a forward windshield 60 and a side windshield 62 for blocking wind for an operator in the cockpit. The presently shown marine vessel 1 further includes a tower 100 that extends upwardly from the tops 24 of the walls 22. Other embodiments may not include a tower 100, or may have a blank plate on the tops 24 of the walls 22 that is removable to add a tower 100 as an aftermarket product. The tower 100 of FIG. 1 is coupled to the walls 22 of the hull 10 via feet 110. The tower 100 further includes a raised section 150 that includes legs 152 extending upwardly from the feet 110 and connected together by a top 156. In the example shown, the raised section 150 is formed of a tubular frame 154, which may comprise stainless steel, carbon composite materials, or other alloys in a customary manner. The tower 100 can be used for anchoring a tow rope held by a wakeboarder or water-skier, for example, in a manner known in the art. A light 158 is also provided on the top 156 of the tower 100, which receives power via a wire harness (162 in FIG. 4) extending through the tubular frame 154. An equipment rack 160 is also shown attached to the tower 100, which is configured to support equipment such as wakeboards, skis, or wake surfing boards in a manner known in the art. The tower 100 is presently shown being coupled to the walls 22 of the hull 10 at of near the midpoint 16. The present inventors have found this position to be particularly advantageous in that the tower 100 and openings 32 have been designed to be integrated or co-located, thereby positioning the openings 32 at or near the maximum height H of the hull 10. However, it should be recognized that the tower 100 and openings 32 may be located together in a different position on the hull 10. Additional information regarding the tower 100 and how it is fixed to the walls 22 is provided below.

Figure 2:
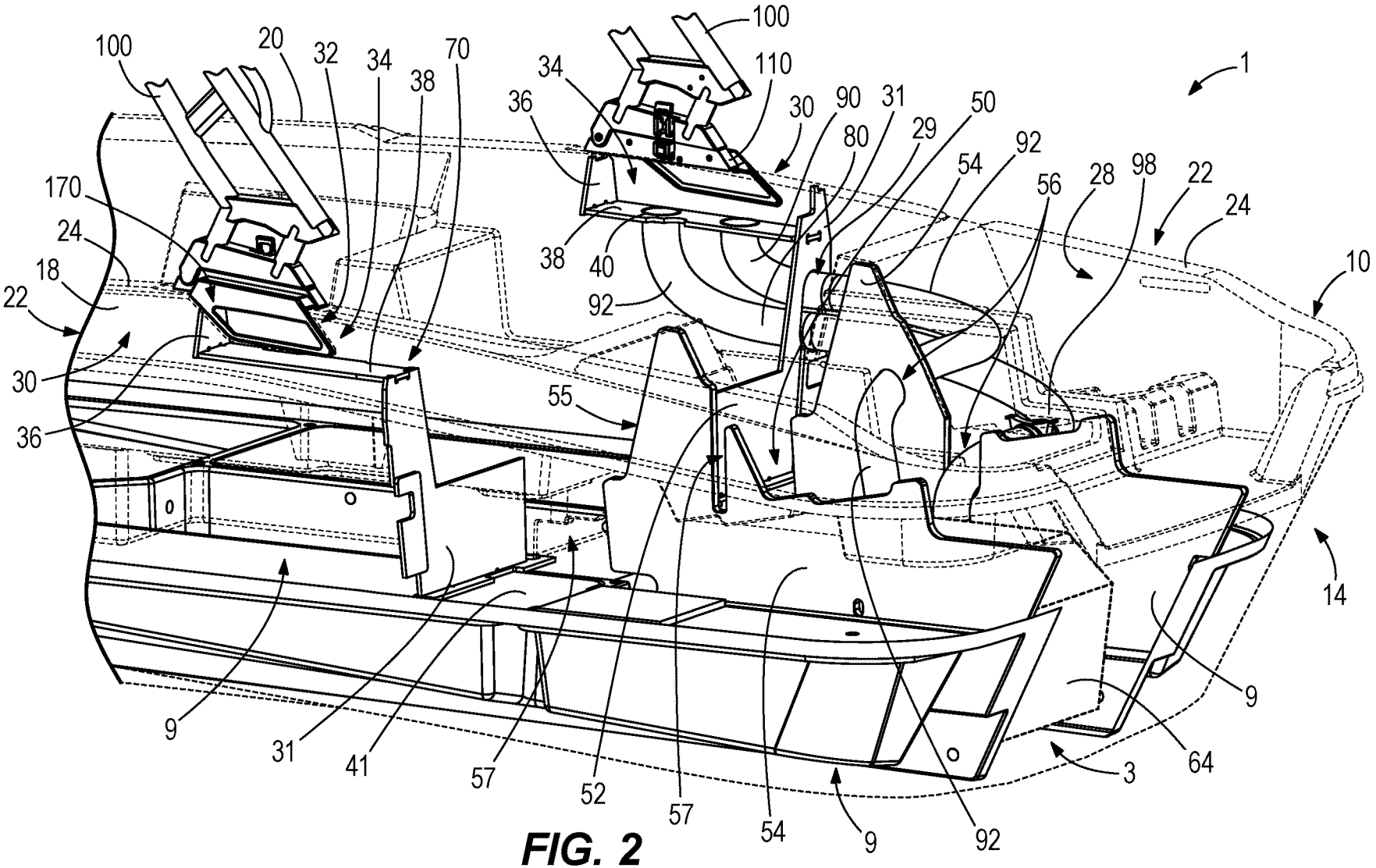
FIG. 2 is a close up isometric view of a port side of the marine vessel of FIG. 1 with the hull partially shown in dashed lines.

FIG. 2 shows the port side 18 of the marine vessel 1 of FIG. 1 with the hull 10 partially shown in dotted lines to reveal the structure 9 within the walls 22 and defining the engine compartment 50. As discussed above, an opening 32 is defined within the outer side 30 of each of the walls 22, which providing ventilating and/or the exhausting for the engine compartment 50. It should be recognized that while the openings 32 are shown here to be in the same locations of the walls 22, one of the openings 32 (e.g., the air intake for ventilating the engine compartment 50) may be positioned elsewhere, for example within the sheltered cockpit area in which the driver is seated. The engine 64 is contained within the engine compartment 50, which is defined by a front wall 52 and side walls 54. The engine compartment 50 may be further defined by the cover 58 of FIG. 1, which for example may form the top and aft wall of the engine compartment 50 when closed. Openings 56 are defined within the side walls 54 to allow tubing 92 to pass through the walls, which as discussed below may be used for communicating the air flow for ventilating and/or exhausting the engine compartment 50. Additional openings 57 are also provided for air flow between the openings 32 of the walls 22 and the engine compartment 50.

Figure 3:
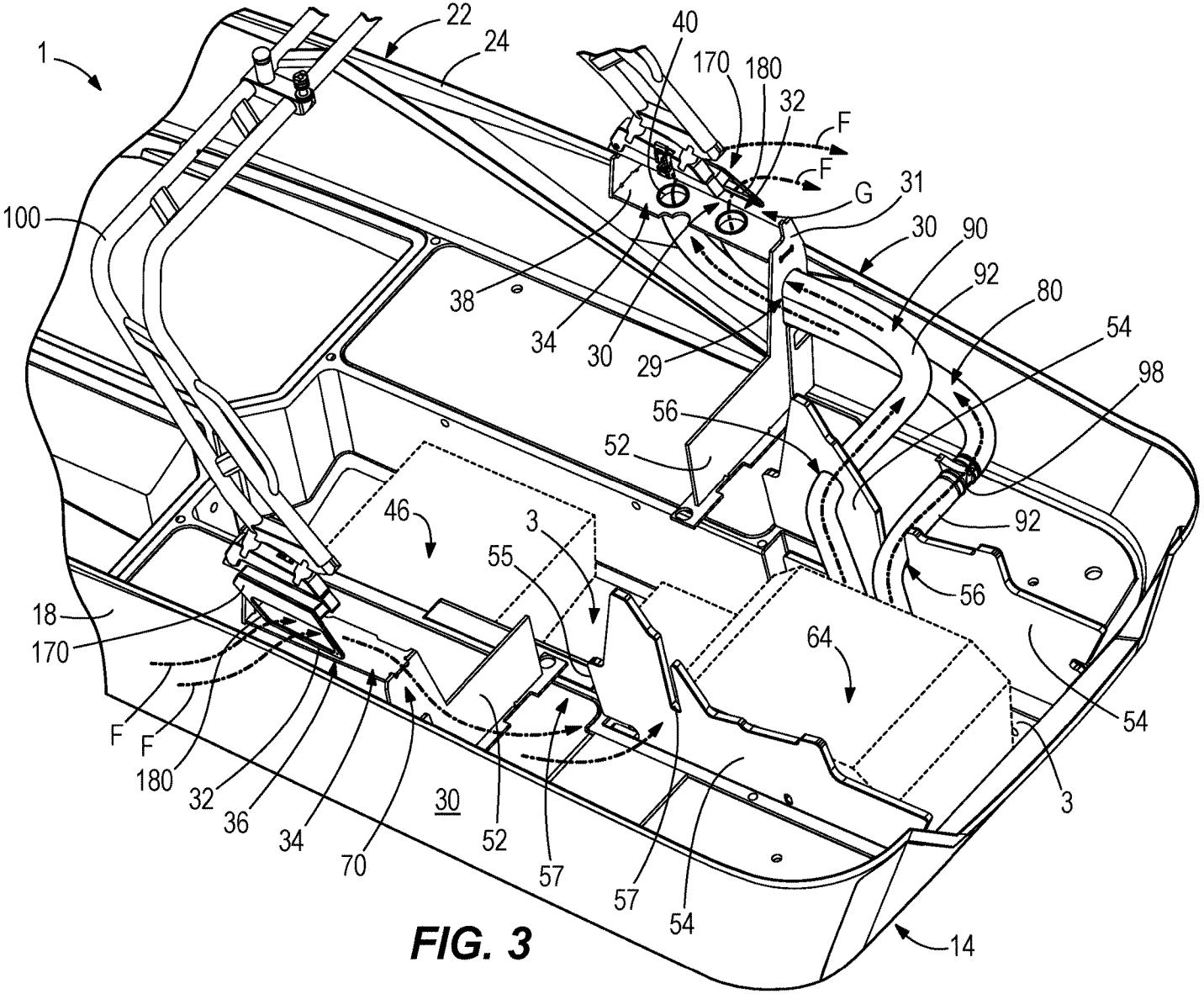
FIG. 3 is an isometric view of the marine vessel of FIG. 2 show air flow through the marine vessel according to the present disclosure.

FIGS. 2 and 3 show one embodiment of a marine vessel 1 having conduits for providing ventilating and exhausting between the openings 32 in the walls 22 and the engine compartment 50. In particular, air flow is provided via a first conduit 70, second conduit 80, and third conduit 90. Starting on the port side 18, a first conduit 70 provides air flow between the openings 32 in wall 22 and the engine compartment 50. In particular, the opening 32 defined in the outer side 30 of the wall 22 is provided in communication with an opening box 34 defined within the interior of the wall 22. The opening box 34 is bounded by an end 36 at the forward end and a floor 38, as well as the inner side 28 (FIG. 1) and outer side 30 of the wall 22. In this manner, air may flow in and/or out of the opening box 34 via the opening 32 in the outer side 30 of the wall 22.

Continuing away from the opening 32 in opening box 34 of the port side 18 in FIGS. 2 and 3, an additional wall 31 extends downwardly from the floor 38 of the opening box 34 down to an additional floor 41 that extends rearwardly toward the stern 14. In this manner, the first conduit 70 between the wall 22 on the port side 18 and the engine compartment 50 is provided by the open interior of the wall 22 (bounded by the inner side 28 and outer side 30). Air flows from opening box 34 along the floor 41 before entering the engine compartment 50 via openings 57 between the wall 31 and a front edge 55 of the side wall 54, or other openings 57 within the side wall 54. The first conduit 70 may also be bounded in certain places by a deck of the marine vessel 1.

In the present example, the first conduit 70 provided within the wall 22 of the port side 18 provides fresh air as ventilation for the engine 64 within the engine compartment 50. The engine compartment 50 is then exhausted out the starboard side 20 as discussed further below. The entire path of air flow from the port side 18 to the starboard side 20 through the engine compartment 50 is shown via the flow arrows F. However, it should be recognized that the sides may be reversed such that the air flows from the starboard side 20 to the port side 18.

The engine compartment 50 is also fluidly coupled to exhaust the air therein via the wall 22 of the starboard side 20 of the marine vessel 1. In the example of FIGS. 2 and 3, exhausting may occur through both a second conduit 80 and a third conduit 90. As with the port side 18, the starboard side 20 of the marine vessel 1 defines an opening in the outer side 30 of the wall 22. The opening 32 in the outer side 30 of the wall 22 of the starboard side 20 also opens to an opening box 34 defined between an end 36, floor 38, and the inner side 28 and outer side 30 of the wall 22. On the starboard side 20, the wall 31 at the aft end of the opening box 34 extends upwardly from the floor 38 (in addition to downwardly therefrom) to close off the rearward portion of the opening box 34. This closure is provide because exhausting at the starboard side 20 occurs via tubing 92, rather than simply providing air flow through the interior of the wall.

With continued reference to FIGS. 2 and 3, holes 40 are defined within the floor 38 of the opening box 34. The second conduit 80 and third conduit 90 communicate with the opening box 34 via the holes, in this example formed by flexible tubing 92. Starting at the holes 40 and the floor 38 of the opening box 34, the second conduit 80 and third conduit 90 each extend (through the tubing 92) through one or more openings 29 in the wall 31 extending downwardly from the opening box 34. The tubing 92 further extends through openings 56 defined within the side walls 54 defining the engine compartment 50 to open within the engine compartment 50 or bilge 3 more generally. As discussed above, the second conduit 80 and the third conduit 90 thereby provide parallel pathways for exhausting the engine compartment 50 to atmosphere via the opening 32 in the wall 22 on the starboard side 20.

FIG. 3 further shows covers 170 with panels 180 horizontally and vertically aligned with the openings 32. As will be discussed further below, the cover 170 is positioned apart from the walls 22 such that a gap G is formed therebetween. The gap G is specifically configured to provide a desired amount of air flow through the opening 32 via the gap G, which nonetheless visually obscuring at least a portion of the opening 32, and also blocking water from entering therein. In the example shown, the gap G is generally consistent across the entire panel 180 of the cover 170 (being approximately 1 inch, or another distance between 0.25 and 2 inches, for example). However, the gap G may also vary across the panel 180, for example increasing as the distance above the water 2 (FIG. 1) increases, and/or increasing from stern to bow, for example.

With continued reference to FIG. 3, the second conduit 80 is provided with a fan 98 that forces air to flow through the second conduit 80, here away from the engine compartment 50. The third conduit 90 also provides a fluid pathway between the engine compartment 50 and outside the hull 10, but passively without a fan coupled therebetween. In this manner, the operator may actuate the fan 98 for a prescribed amount of time before starting up the engine 64 to ensure that no explosive vapors have built up within the engine compartment 50, including from either the fuel tank 46 or engine 64 in a customary manner.

As discussed above and with reference to FIG. 1, the present inventors have configured the walls 22 of the hull 10 to have a highest height H at or near the midpoint 16 thereof, and further positioned the openings 32 at or near this midpoint 16. Through experimentation and development, the present inventors have further recognized that positioning the openings 32 at or near the midpoint 16 of the marine vessel 1 subjects the openings 32 to less spray and splashing during operation of the marine vessel by being farther from both the bow 12 and stern 14. This includes the spray of the bow 12 driving through the water 2 in operation, and also the spray caused by activity such as wake boarding and wake surfing occurring at the stern 14. In this manner, the positions of the openings 32 are farthest (or near farthest) from the water 2 vertically, and also from the bow 12 and stern 14 horizontally.

In addition to positioning the openings 32 farther from the water 2, the bow 12 and the stern 14, the present inventors have recognized that positioning the openings 32 below the tower 100 provides further physical protection for the openings 32 and related grates or louvers. The position further reduces the possibility of water entering the bilge via the openings 32 from passengers. For examples, swimmers cannot walk over the openings 32 when returning from the water 2, nor physically contact the openings 32 (and relates grates or louvers, including the cover 170), due to the tower 100 being an obstacle. Additionally, the present inventors have recognized that positioning the openings 32 in conjunction with the tower 100, and particularly directly below the tower 100, has additional advantages for manufacturing and serviceability.

Figure 4:
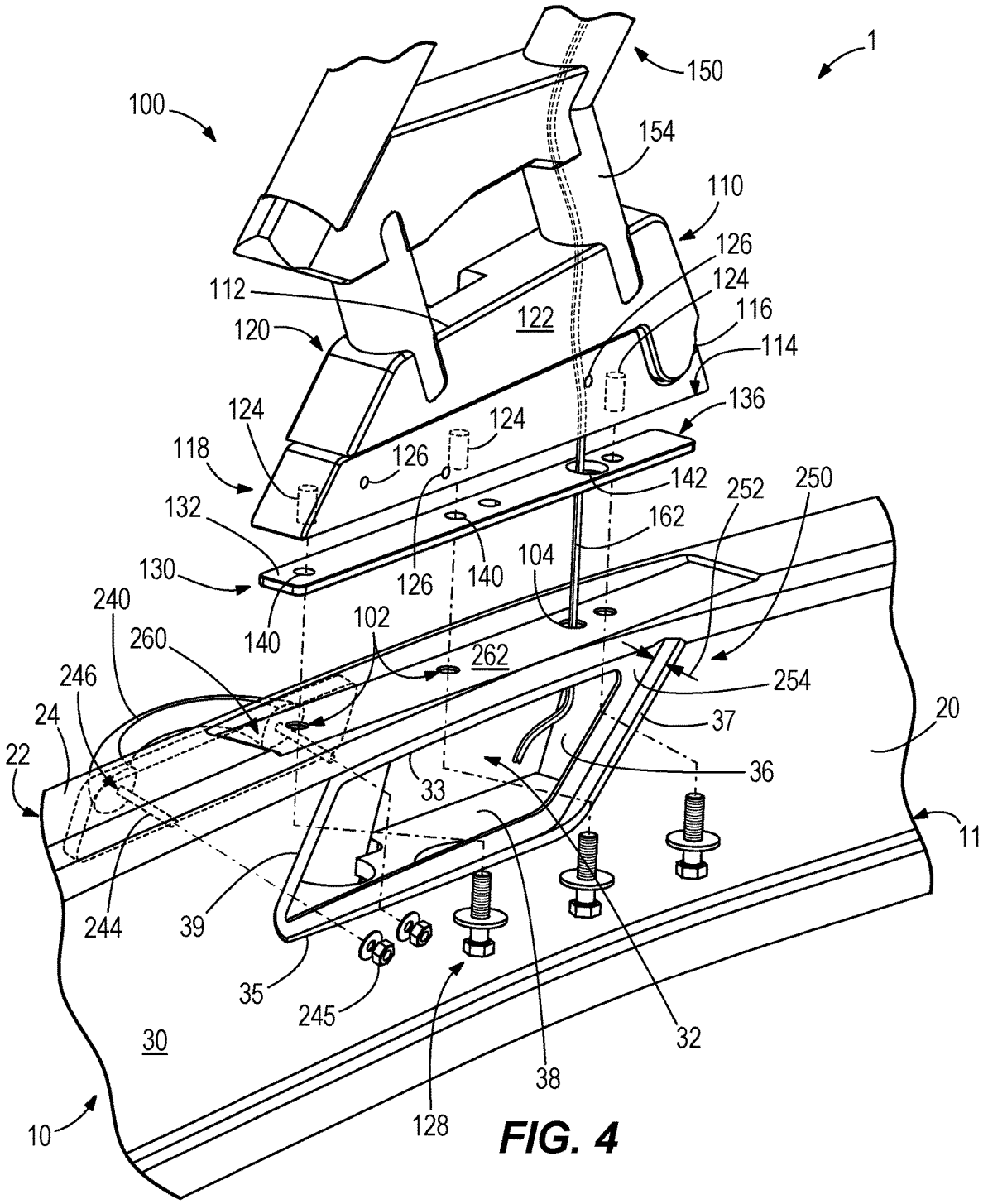
FIG. 4 is an exploded close-up view of FIG. 1 with the cover shown removed.

FIG. 4 is an exploded view depicting how the tower 100 is coupled to the top 24 of each of the opposing walls 22. The tower 100 includes feet 110 that extend between tops 112 and bottoms 114, between a forward end 116 and a back end 118, and between an inside 120 and outside 122. Openings 124 are defined within the bottom 114 of the feet 110, which in the present example are threaded. The openings 124 are configured to receive a fastener 128 from below, such as a screw or bolt, for example, as discussed further below. Openings 126 are also defined entirely through the inside 120 and the outside 122, which in the present example are through holes of a smooth bore.

With continued reference to FIG. 4, a plate 130 is sandwiched between the bottom 114 of the feet 110 and the tops 24 of the walls 22. In the example shown, a recess 260 is provided within the top 24 of the wall 22, whereby the plate 130 is at least partially received within the recess 260. The plate 130 extends between a top 132 and bottom, in between a forward end 136 and opposite back end. Openings 140 are provided through the top 132 and bottom, which are configured to align with the openings 124 of the feet 110. The plate 130 also includes one or more openings 142 through the top 132 and bottom configured to align such that a wiring harness 162 exiting the tubular frame 154 of the tower 100 may extend therethrough. The wiring harness 162 may for example provide electricity and communication to lights, speakers, and other devices mounted to the tower 100.

The tower 100 is coupled to the tops 24 of the walls 22 by positioning the plate 130 on the tops 24 of the walls 22 with the feet 110 above the plates 130. The openings 140 in the plate and the openings 124 in the feet 110 align with openings 102 defined through the tops 24 of the walls 22. Similarly, an opening 104 is provided through the top 24 of the wall 22 on at least one side of the marine vessel 1, which aligns with the opening 142 in the plate 130 and with the wiring harness 162 extending through the tubular frame 154 of the tower 100. The tower 100 is therefore anchored to the hull 10 by threaded engagement between fasteners 128 extending upwardly through the openings 102 in the top 24 of the wall 22, through the openings 140 and the plate 130, and into the openings 124 and the feet 110 of the tower 100.

FIG. 4 also shows further detail for exemplary openings 32 in the outer side 30 of the wall 22, whereby the openings 32 extend between a top 33 and a bottom 35, and a front end 37 and a back end 39. In certain examples, the opening 32 has a height between the top 33 and the bottom 35 between 2" and 9" (e.g., approximately 3.25") and a length between the front end 37 and the back end 39 between 6" and 2' (e.g., approximately 1' or 1'1"). The openings 32 are positioned closer to the top 24 of the wall 22 than to the rub rail 11. In certain examples, the top 33 of the opening 32 is between 0.25" and 3" from the top 24 of the wall (e.g., approximately 0.5") or generally between 0.25" to 6" from the bottom 114 of the feet 110, depending on the amount of support needed for the tower 100. In the example shown, a recess 250 having a depth 252 is provided within the outer side 30, terminating at a backstop 254. In this manner, the openings 32 has a surface area that reduces from the outer side 30 of the wall 22 to the inner side 28. The recess 250 shown here serves two purposes. First, the recess 250 adds a desirable aesthetic to the marine vessel 1, adding depth and interest. Additionally, the recess 250 provides additional space between the opening 32 and the cover 170 for improved air flow.

The present inventors have recognized that configuring the opening 32 in this manner within the outer side 30 of the walls 22, and below the tower 100, provides easy and unobstructed access to the fasteners 128 for installing the tower 100. The openings 32 also have sufficient size to manipulate a tool therein, for example to install a bolt as the fastener 128 from below the tower 100 using a socket wrench or torque tool. This provides for efficient production of the marine vessel 1, as well as for simple maintenance, changing towers 100 or installing a tower 100 as an after-market product. Towers presently known in the art are not able to be installed on the tops 24 of the walls 22, and/or require permanent threaded studs to extend upwardly from a mount plate on the tops 24 of the walls 22. In other words, without the openings 32 being provided and positioned below the tower 100 as presently discussed, there is no access to install a tower 100 from below, and particularly in an ergonomic fashion with clear access to the fasteners 128.

Figure 5:
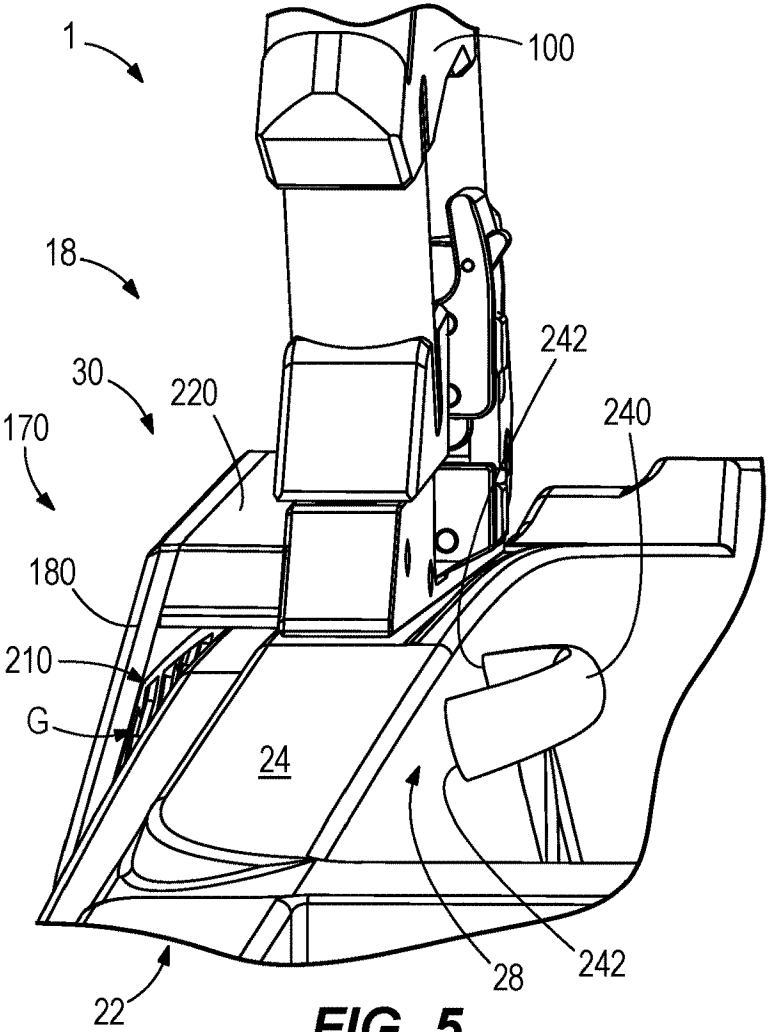
FIG. 5 is a close-up rear view of the port wall of the marine vessel of FIG. 1.

With continued reference to FIG. 4, the openings 32 within the outer sides 30 of the walls 22 also provide for convenient installation of a handle 240 provided for the comfort and safety of passengers. As shown in FIGS. 4 and 5, the handle 240 has an arched shape extending between base ends 242. Fasteners 244 are used for coupling the handle 240 to one of the walls 22, such as threaded studs extending away from the base ends 242, for example. As shown in FIG. 4, the openings 32 in the outer sides 30 of the walls 22 provide for convenient access to engage the fasteners 244 of the handles 240 with corresponding fasteners 245, which in the present example is a washer and nut threading engaging the fastener 244 to secure the handle 240 to the wall 22. The handle 240 may also be configured to have threaded openings within the base ends 242 similar to the feet 110 of the tower 100, configured to be secured to the walls 22 via fasteners such as bolts from inside the openings 32 in the walls 22.

In this manner, the openings 32 are particularly convenient for mounting the handles 240, tower 100, or other items, whereby the installation personnel has direct line of sight with fasteners 244 and fasteners 245, rather than working blindly within the walls 22 from inside the hull or other techniques presently known in the art. Likewise, electrical connections for the tower 100 (or other accessories, such as a horn, depth finder, and/or the like) may be made via the openings 32. For example, connections or service may be provided to the wire harness 162 extending through the tower 100 via the opening 32.

Figure 6:
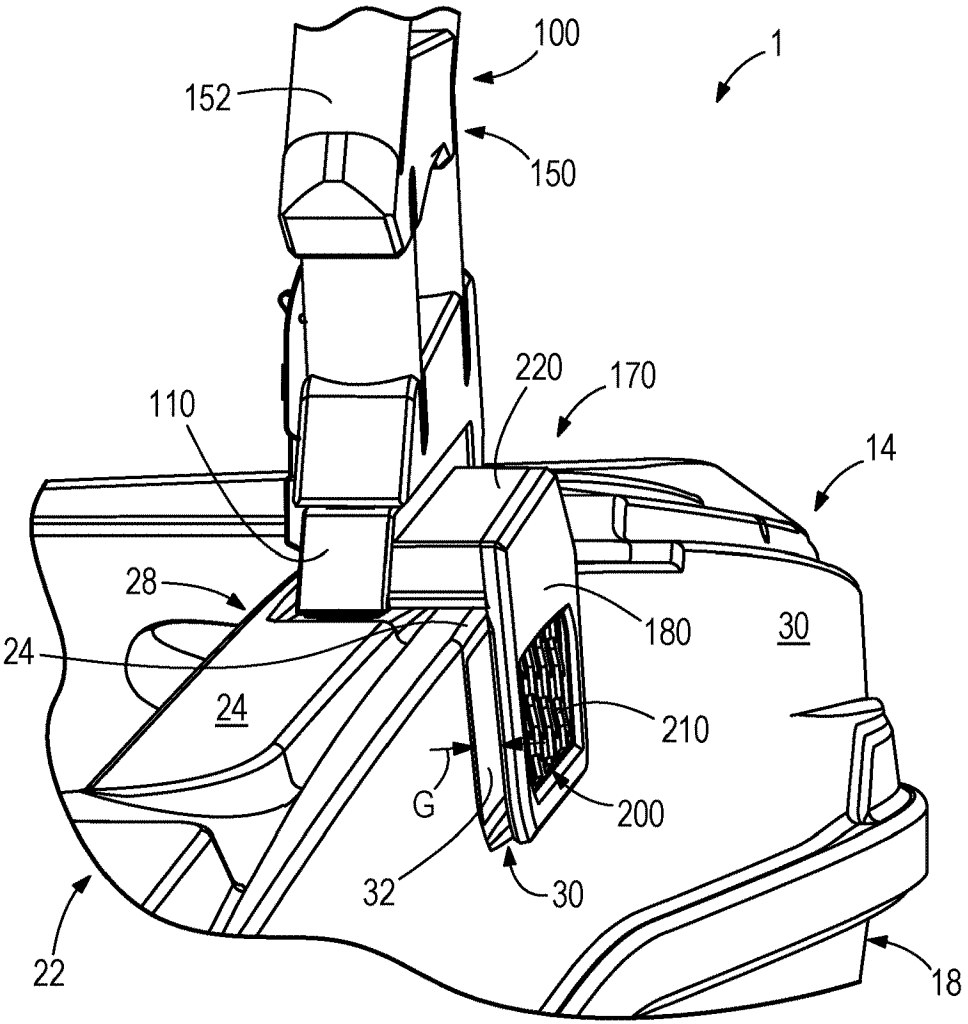
FIG. 6 is a close-up rear view of the starboard wall of the marine vessel of FIG. 1.

As discussed above, water is further prevented from entering the openings 32 by the inclusion of covers 170 horizontally and/or vertically aligned with the openings 32. FIGS. 5 and 6 depict a cover 170 according to the present disclosure, which prevents or reduces the amount of water entering the openings 32 through use of the marine vessel 1. Each of the covers 170 includes a panel 180 coupled to one of the feet 110 of the tower 100 via an arm 220 positioned therebetween. The configuration provides for a gap G between the panel 180 and the outer side 30 of the wall 22, providing air flow for the opening 32 while also blocking water from entering.

Figure 7:
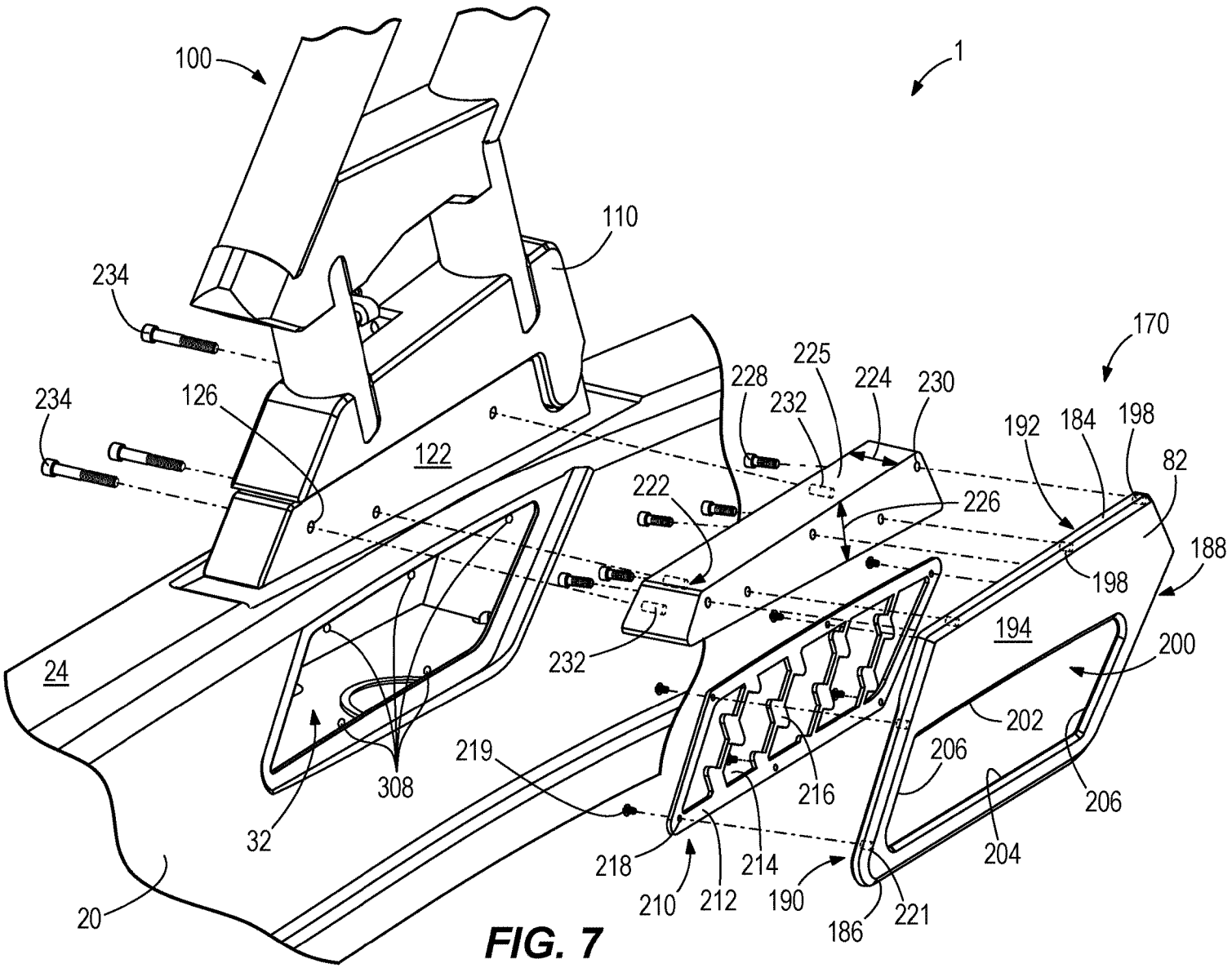
FIG. 7 is an close-up view of FIG. 1 similar to FIG. 6 with the cover shown exploded.

FIG. 7 shows an exploded view of the cover 170 removed from the tower 100. The cover 170 includes a panel 180, as well as the arm 220 for coupling the panel 180 to the tower 100, and particularly the feet 110 thereof. The panel 180 includes a frame 82 that extends between a top 184 and a bottom 186, between a forward end 188 and a back end 190, and between an inside 192 and an outside 194. Openings 198 are defined within the panel 180 from the inside 192, which in the present example are threaded. An opening 200 is defined within the panel 180, which is configured to align with a grate 210. In particular, the opening 200 extends between a top 202, a bottom 204, and ends 206.

The grate 210 is formed by a frame 212 having ribs 216 spaced apart between the forward end and the back end (oriented generally the same as the forward end 188 and back end 190 of the frame 82). The ribs 216 may have an aesthetically pleasing design, as ribs 216 are visible to the opening 200 in the panel 180. Openings 214 are provided between the ribs 216, which the present inventors have particularly sized to provide sufficient air flow through the grate 210 and therefore panel 180 in addition to the airflow through the gap G between the panel 180 and the outer side 30 of the wall 22. In certain examples, lights 300 (e.g., LEDs) are positioned within the openings 32 such that a glow is visible through the openings 214 in the grate 210, for example. The lights 300 may change color or intensity based on operator controls, whether the fan 98 (FIGS. 2 and 3) is operating, or based on the operation of the boat.

Openings 218 are defined through the grate 210, which enables the grate 210 to be coupled to the inside 192 of the panel 180 via fasteners 219 received through the grate 210 and into the openings 198 of the panel 180. Exemplary fasteners 219 include screws, bolts, or press-fit connectors. However, it should be recognized that the grate 210 may also be coupled to the frame 212 via adhesives, hook and loop fasteners, welds, rivets, or other methods known in the art.

With continued reference to FIG. 7, the cover 170 further includes the arm 220, which extends a width 222, a depth 224, and a height 226. Openings 230 are defined through the entire depth 224 of the arm 220, which are configured to receive fasteners 228 therethrough. The fasteners 228 (e.g., screws or bolts) are received within the openings 198 in the panel 180 to couple the arm 220 to the panel 180. Likewise, openings 232 are defined into the arm 220, though not necessarily entirely through the depth 224 thereof. The openings 232 are configured to threadingly receive fasteners 234 receive through the openings 126 in the feet 110 to threadingly couple the arm 220 to the tower 100.

The size, shape, and stylistic features of the cover 170 may vary from what is shown. It should be recognized that the height between the top 184 and bottom 186 of the panel 180, size of the openings 200, and the location of the opening 200, are particularly selected to align the opening 200 with the openings 32 in the walls 22 to provide the desired air flow through the opening 200 and gap G (FIGS. 5 and 6).

In this manner, the marine vessel 1 provides for the desired air flow for ventilating and exhausting the engine compartment 50, while also preventing water ingress, protecting the openings 32 and related grates or louvers, and also improving manufacturability.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A marine vessel comprising:

a hull extending horizontally from a bow to a stern with a midpoint therebetween, the hull having opposing walls that extend upwardly, wherein the opposing walls have inner sides that face inwardly toward each other and outer sides that face outwardly, wherein a first of the outer sides defines a first opening therein, and wherein the first opening is horizontally closer to the midpoint than to the stern and horizontally closer to the midpoint than to the bow;

an engine compartment configured for positioning an engine therein; and a first conduit fluidly coupling the first opening and the engine compartment for at least one of ventilating and exhausting the engine compartment, wherein at least a portion of the first conduit extends horizontally and/or vertically within at least one of the opposing walls between the inner side and the outer side thereof;

wherein the first opening is positioned to prevent water from entering the first conduit.

2. A marine vessel comprising:

a hull extending horizontally from a bow to a stern with a midpoint therebetween, the hull having opposing walls that extend upwardly, wherein the opposing walls have inner sides that face inwardly toward each other and outer sides that face outwardly, wherein a first of the outer sides defines a first opening therein, and wherein the first opening is horizontally closer to the midpoint than to the stern and horizontally closer to the midpoint than to the bow;

an engine compartment configured for positioning an engine therein;

a first conduit fluidly coupling the first opening and the engine compartment for at least one of ventilating and exhausting the engine compartment, wherein the first opening is positioned to prevent water from entering the first conduit; and a tower having opposing feet with a raised section therebetween, wherein the opposing feet are coupled to the opposing walls, and wherein one of the opposing feet is horizontally aligned at least in part with the first opening.

3. The marine vessel according to claim 2, wherein the one of the opposing feet is vertically above the first opening.

4. The marine vessel according to claim 2, wherein the opposing walls extend upwardly to tops between the inner sides and the outer sides, and wherein the opposing feet are positioned on the tops of the opposing walls.

5. The marine vessel according to claim 2, wherein one of the opposing feet is coupled to the first of the opposing walls via fasteners accessible via the first opening.

6. The marine vessel according to claim 2, wherein the first of the outer sides provides for ventilating the engine compartment, wherein a second of the outer sides defines a second opening therein, further comprising a second conduit fluidly coupling the second opening and the engine compartment for exhausting the engine compartment, wherein the second opening is positioned to prevent water from entering the second conduit.

7. The marine vessel according to claim 6, further comprising a fan configured to force air from the engine compartment via the second conduit.

8. The marine vessel according to claim 7, further comprising a third conduit fluidly coupling the second opening and the engine compartment, wherein the third conduit is also configured to exhaust the engine compartment, wherein the third conduit is devoid of fans between the engine compartment and the third opening.

9. A marine vessel comprising:

a hull extending horizontally from a bow to a stern with a midpoint therebetween, the hull having opposing walls that extend upwardly, wherein the opposing walls have inner sides that face inwardly toward each other and outer sides that face outwardly, wherein a first of the outer sides defines a first opening therein, and wherein the first opening is horizontally closer to the midpoint than to the stern and horizontally closer to the midpoint than to the bow;

an engine compartment configured for positioning an engine therein;

a first conduit fluidly coupling the first opening and the engine compartment for at least one of ventilating and exhausting the engine compartment, wherein the first opening is positioned to prevent water from entering the first conduit; and a panel at least partially covering the first opening, wherein a gap is formed between the panel and the first of the outer sides, wherein the at least one of the ventilating and the exhausting of the engine compartment occurs at least in part via the gap.

10. The marine vessel according to claim 9, further comprising a tower having opposing feet with a raised section therebetween, wherein the opposing feet are coupled to the opposing walls, and wherein the panel is coupled to the tower via an arm to provide the gap between the panel and the first of the outer sides.

11. The marine vessel according to claim 9, wherein the panel defines openings therethrough, and wherein the at least one of the ventilating and the exhausting of the engine compartment occurs via both the gap and the openings in the panel.

12. The marine vessel according to claim 9, wherein the gap has a distance between the panel and the first opening that is substantially constant across the panel.

13. The marine vessel according to claim 9, further comprising a handle coupled to the first of the opposing walls via fasteners accessible via the first opening.

14. The marine vessel according to claim 1, wherein the opposing walls each have a height between a bottom and a top that varies between the bow and the stern, wherein the height of the first of the outer sides where the first opening is defined is greater than the height of the first of the outer sides at the bow and greater than the height of the first of the outer sides at the stern.

15. A method for assembling a marine vessel, the method comprising:

providing a hull extending horizontally from a bow to a stern with a midpoint therebetween, the hull having opposing walls that extend upwardly, wherein the opposing walls have inner sides that face inwardly toward each other and outer sides that face outwardly;

configuring the outer sides to define a first opening and a second opening therein, respectively, wherein the first opening and the second opening are each horizontally closer to the midpoint than to the stern and horizontally closer to the midpoint than to the bow;

providing an engine compartment configured for positioning an engine therein; and fluidly coupling the engine compartment to the first opening via a first conduit for ventilating the engine compartment, and fluidly coupling the engine compartment to the second opening via a second conduit for exhausting the engine compartment, such that at least a portion of at least one of the first conduit and the second conduit extends horizontally and/or vertically within at least one of the opposing walls between the inner side and the outer side thereof;

wherein the first opening and the second opening are each positioned to prevent water from entering the first conduit and the second conduit, respectively.

16. The method according to claim 15, further comprising coupling a tower to the opposing walls, wherein the tower comprises opposing feet with a raised section therebetween, and wherein the opposing feet are horizontally aligned at least in part with the first opening and the second opening, respectively.

17. The method according to claim 16, wherein the opposing feet are coupled to the opposing walls via fasteners accessible via the first opening and the second opening, respectively.

18. The method according to claim 15, further comprising operatively coupling a fan to the second conduit to force air from the engine compartment via the second conduit.

19. The method according to claim 15, further comprising coupling a tower to the opposing walls, and further comprising coupling first and second panels to the tower via first and second arms such that gaps are formed between the first and second panels and the outer sides of the opposing walls, respectively, wherein the ventilating and the exhausting of the engine compartment occurs via the gaps, respectively.

20. A marine vessel configured to have an engine, the marine vessel comprising:

a hull horizontally extending from a bow to a stern with a midpoint therebetween, the hull having opposing walls that extend upwardly to tops, wherein the opposing walls have inner sides that face inwardly toward each other and outer sides that face outwardly, wherein the outer sides define a first opening and a second opening therein, respectively, and wherein the first opening and the second opening are each horizontally closer to the midpoint than to the stern and horizontally closer to the midpoint than to the bow;

an engine compartment configured for positioning the engine therein; and a first conduit fluidly coupling the first opening and the engine compartment for ventilating the engine compartment, and a second conduit fluidly coupling the second opening and the engine compartment for exhausting the engine compartment, wherein the first opening and the second opening are positioned to prevent water from entering the first conduit and the second conduit, respectively;

a fan operatively coupled within the second conduit to force air from the engine compartment via the second conduit; and a tower having opposing feet with a raised section therebetween, wherein the opposing feet are coupled to the tops of the opposing walls and horizontally aligned at least in part with the first opening and the second opening, respectively, and wherein the opposing feet are coupled to the opposing walls via fasteners accessible via the first opening and the second opening, respectively.

* * * * *